US005188524A

United States Patent [19]

Bassine

[11] Patent Number: 5,188,524

[45] Date of Patent: Feb. 23, 1993

[54] PIVOTING VANE ROTARY COMPRESSOR

[76] Inventor: Stuart Bassine, 1800 Marina Cir., N. Fort Myers, Fla. 33903

[21] Appl. No.: 858,900

[22] Filed: Mar. 27, 1992

[51] Int. Cl.[5] ..... F04C 18/44

[52] U.S. Cl. ..... 418/152; 418/178; 418/268

[58] Field of Search ..... 418/152, 178, 239, 267, 418/268, 269

[56] References Cited

U.S. PATENT DOCUMENTS

| | | | |
|---|---|---|---|
| 236,732 | 1/1881 | Sutton | 418/268 |
| 726,907 | 5/1903 | Gulich | 418/239 |
| 3,162,141 | 12/1964 | Vlachos | 418/268 |
| 3,304,838 | 2/1967 | McDonald | 418/152 |

FOREIGN PATENT DOCUMENTS

| | | | |
|---|---|---|---|
| 122069 | 9/1946 | Australia | 418/152 |
| 3423276 | 1/1986 | Fed. Rep. of Germany | 418/268 |
| 998602 | 9/1951 | France | 418/239 |
| 58-204992 | 11/1983 | Japan | 418/268 |
| 2074246 | 10/1981 | United Kingdom | 418/267 |
| 2169965 | 7/1986 | United Kingdom | 418/267 |

*Primary Examiner*—John J. Vrablik
*Attorney, Agent, or Firm*—William E. Noonan

[57] ABSTRACT

A pivoting vane rotary compressor is disclosed including a housing having a generally cylindrical chamber. A generally cylindrical rotor is mounted eccentrically in the chamber to define about the rotor a main chamber region, which narrows to a constricted chamber region. An intake port is formed in the housing for introducing air into the main chamber region. An exhaust port is formed in the housing for discharging air from the constricted chamber region. At least one pair of vane elements are pivotably mounted to the rotor and extend therefrom into the chamber. The rotor is rotatably driven such that the vane elements engage the cylindrical wall of the chamber and each pair of vane elements defines a compartment that transmits air from the main chamber region to the constricted chamber region, whereby air is compressed and discharged through the exhaust port.

7 Claims, 2 Drawing Sheets

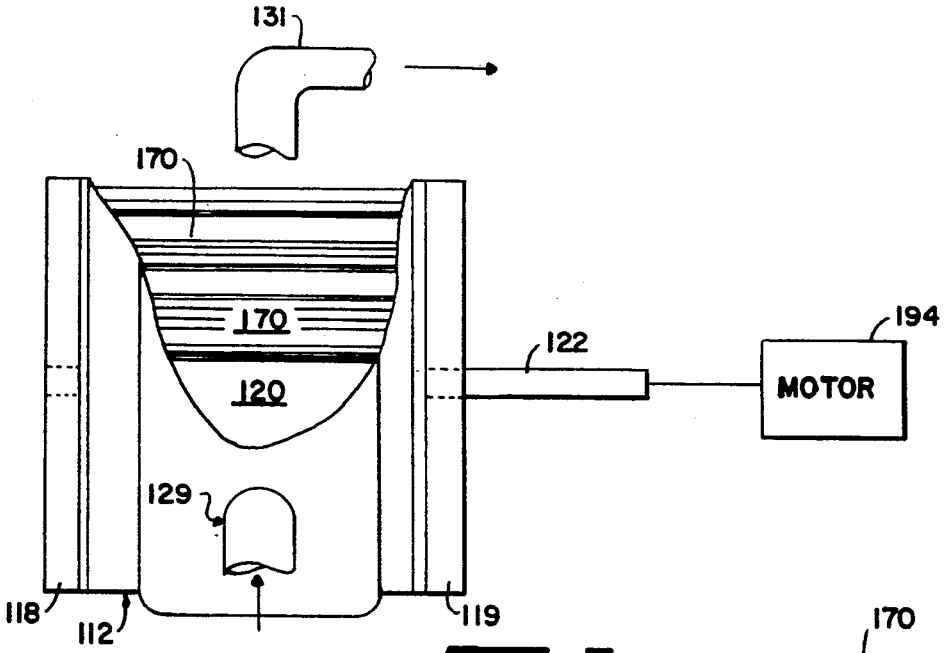
Fig. 3
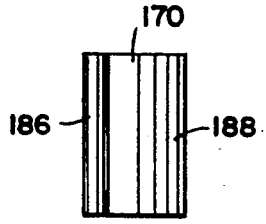
Fig. 6
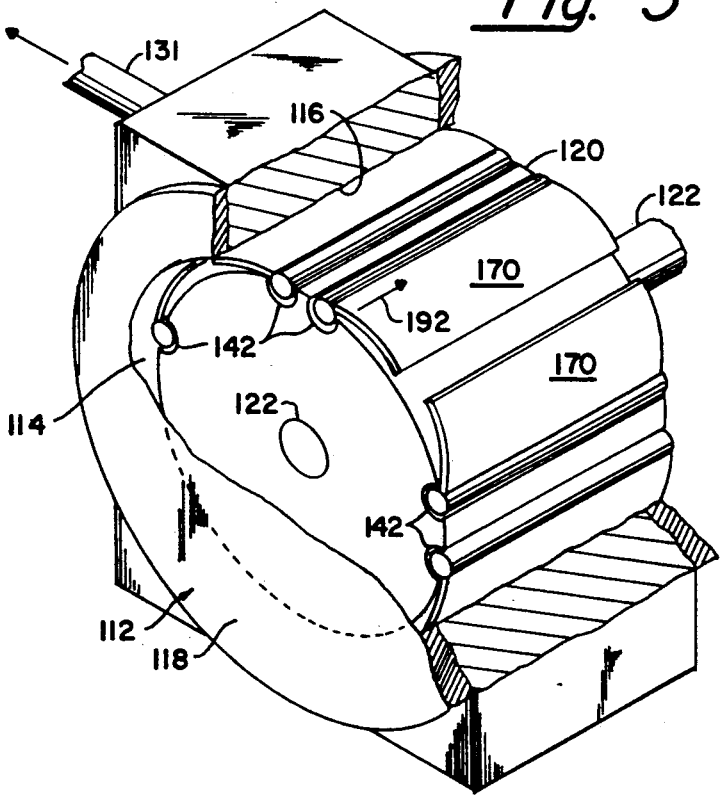
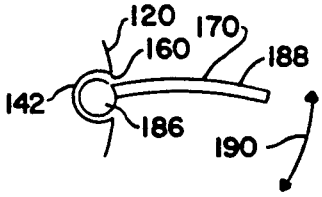
Fig. 5
Fig. 4

PIVOTING VANE ROTARY COMPRESSOR

FIELD OF INVENTION

This invention relates to a rotary compressor and, in particular, to a pivoting vane rotary compressor that is suited for use in oxygen concentrators and other applications.

BACKGROUND OF INVENTION

Conventional oxygen concentrators often employ a rotary compressor to pump air through the concentrator and to the patient. Such compressors provide a desirably high rate of air flow and do not generate excessive pressures. The typical rotary compressor features carbon vanes that are slidably mounted in generally radial slots in the compressor's rotor. The rotor itself is eccentrically mounted in a chamber formed in the housing of the compressor. An electric motor drives the rotor such that centrifugal force urges the carbon vanes outwardly from their slots to engage the wall of the chamber. The vanes form successive compartments that collect air that is introduced into the compressor. As the vanes rotate, the air is moved into a gradually constricted portion of the chamber where it is compressed. This compressed air is then delivered through an exhaust port to the concentrator's filter.

Conventional carbon vane rotary compressors exhibit at least a couple of significant problems. As each vane slides back and forth within its respective slot, a considerable amount of heat is generated. Moreover, the friction resulting from such sliding causes the vanes to wear and generates carbon dust, which can foul the compressor. As a result, these types of compressors required frequent maintenance. In particular, the dust must be removed and the vanes replaced at regular intervals. Moreover, due to the constant wear on the vanes, known rotary compressors are very likely to exhibit gaps between the ends or tips of the vanes and the chamber wall. This can result in air leakage, which may significantly impair the operation of the compressor and the oxygen concentrator.

SUMMARY OF INVENTION

It is therefore an object of the present invention to provide an improved rotary compressor that utilizes a durable, wear resistant pivoting vane construction.

It is a further object of this invention to provide a rotary compressor that significantly reduces the problems exhibited by conventional sliding carbon vane compressors including carbon dust formation, excessive heat generation and air leakage.

It is a further object of this invention to provide a rotary compressor that requires significantly less repairs and maintenance than are needed by conventional sliding carbon vane compressors.

This invention features a pivoting vane rotary compressor that includes a housing having a generally cylindrical chamber. A generally cylindrical rotor is mounted eccentrically in the chamber to define about the rotor a main chamber region, which narrows to a constricted chamber region. An intake port is formed in the housing for introducing air into the main chamber region. An exhaust port is formed in the housing for discharging air from the constricted chamber region. There is at least one pair of vane elements pivotably mounted to the rotor and extending therefrom into the chamber. Means are provided for rotatably driving the rotor such that the vane elements engage the wall of the chamber and each pair of vane elements defines a compartment that transmits air from the main chamber region to the constricted chamber region. As a result, air is compressed and discharged through the exhaust port.

In a preferred embodiment the rotor includes a plurality of longitudinal channels and each vane element includes a pin portion that is rotatably received by a respective channel to permit the vane element to pivot relative to the rotor. The vane element may further include an arcuate portion that extends from the pin portion. Respective vane elements of each pair include arcuate portions that extend in generally opposite directions about the rotor.

Each vane element may comprise a heat resistent material such as Teflon ( TM ). The wall of the chamber may also comprise Teflon or some other heat resistent material. At least one of the intake and exhaust ports may include a chamfered entrance that permits the tip of the pivoting vane to pass over the port as the vane is driven about the chamber.

DETAILED DESCRIPTION OF PREFERRED EMBODIMENT

Other objects, features and advantages will occur from the following description of a preferred embodiment and the accompanying drawings in which:

FIG. 3 is an elevational, side view, partly in schematic, of the pivoting vane rotary compressor;

FIG. 4 is a perspective, partly cut away view of the pivoting vane rotary compressor;

FIG. 5 is an elevational end view of a pivoting vane as received by its respective rotor channel; and FIG. 6 is a top view of the pivoting vane.

Figure 1:
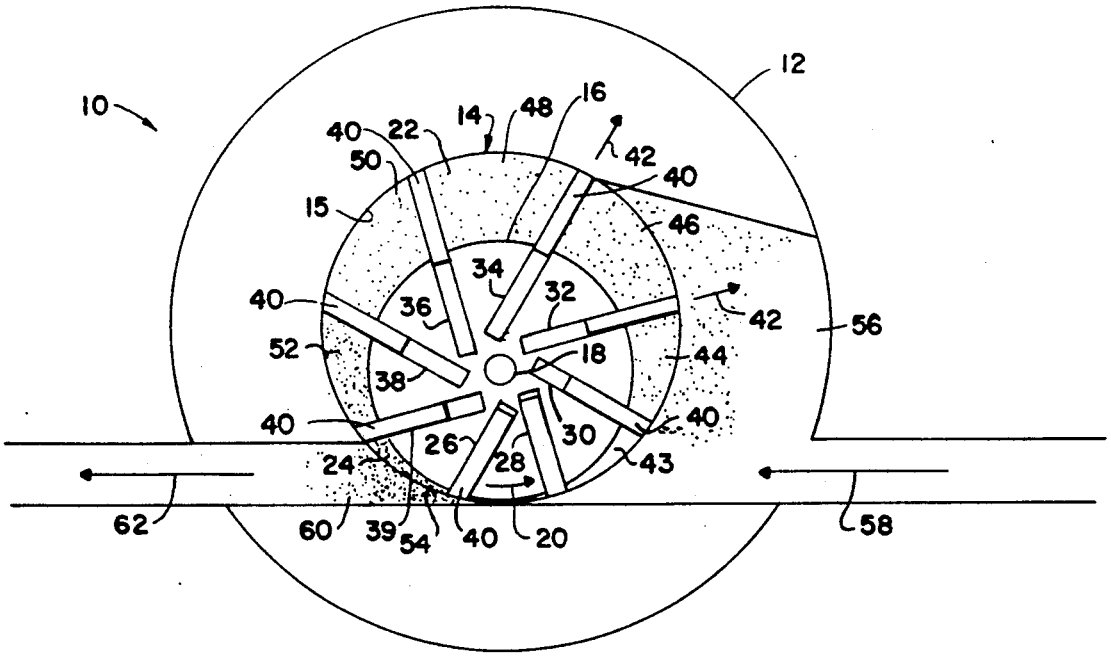
Fig. 1 (PRIOR ART)
FIG. 1 is an elevational diagrammatic view of a conventional sliding carbon vane rotary compressor.

There is shown in FIG. 1 a conventional sliding carbon vane rotary compressor 10 that includes a housing 12 having a cylindrical inner chamber 14. A wall 15 surrounds and defines the chamber. A conventional air inlet 56 is formed for introducing incoming air 58 into chamber 16 and a conventional exhaust port 60 is provided for discharging compressed air from the chamber.

A cylindrical rotor 16 is eccentrically mounted within chamber 14 on a shaft 18. The shaft is fixed to rotor 16 and rotatably mounted to housing 12 in a conventional manner. As a result, rotor 16 and the inner wall 15 of chamber 14 define a main chamber region 22, which narrows to a constricted chamber region 24. More particularly, main region 22 includes the vast majority of the space between rotor 16 and wall 15 and communicates with intake port 56. Constricted region includes only a relatively small portion proximate exhaust port 60.

A plurality of generally radial slots 26, 28 30, 32, 34, 36 and 38 are formed in rotor 16. Each such slot extends to the circumferential surface of the rotor. A conventional carbon vane 40 is slidably received by each of the slots 26–38. More particularly, each carbon vane 40 has a generally planar or plate-like shape and a uniform size. When rotor 16 is at rest and a carbon vane 40 is inserted into a respective slot, the vane generally fills the slot and extends to the circumferential surface of rotor 16. This is best exhibited by the vane 40 in slot 26.

Shaft 18 is rotatably driven by conventional means such as a DC motor, not shown, so that rotor 16 rotates in the direction of arrow 20. As rotor 16 is driven within chamber 14 in this manner, each vane 40 is urged generally radially outwardly, as indicated by arrows 42, due to centrifugal force. More specifically, each vane is urged outwardly until its distal end engages the inner wall 15 of chamber 14. At the rotational position where the rotor passes proximate wall 15, the vane 40 does not extend a great distance from the rotor and its respective slot remains virtually filled. This is again best exhibited by vane 40 in slot 26. However, as rotor 16 continues to rotate in the direction of arrow 20, each slot passes through the increasingly wider main region 22 of chamber 16. Within this region, the inner chamber wall 15 is spaced apart an increasingly gradually greater distance from the surface of rotor 16. As a result, centrifugal force urges each vane 40 increasingly outwardly from its slot and against inner wall 15. This is shown by vanes 40 in slots 30, 32 and 34. Finally, as each slot approaches and passes through constricted region 24, its vane 40 is urged gradually back into its respective slot, as shown by the vanes in slots 36, 38, 39 and 26. As a result, adjacent pairs of vanes 40 define compartments 42, 44, 46, 48, 50, 52 and 54 that rotate about chamber 14 and continuously change size.

In operation, air is introduced through air intake port 56 into, for example, the compartments 42, 44 and 46 formed by the rotating vanes 40. As rotor 16 continues to rotate in the direction of arrow 20, vanes 40 drive the incoming air through main chamber region 22 toward constricted chamber region 24. More particularly, the air is moved to, for example, the successive positions illustrated by compartments 48, 50 and 52. As the vanes 40 proceed about the chamber they are gradually pushed back into their respective slots and the compartments 48, 50 and 52 progressively narrow. The air is thereby driven successively through the positions illustrated by compartments 46, 48, 50 and 52 until it reaches the constricted region 24 of chamber 16. As a result, the air is compressed within the narrowing compartments. Finally, this compressed air is discharged, as indicated by arrow 62, through exhaust port 60.

The conventional apparatus described above exhibits a number of disadvantages. For example, the sliding motion of the vanes 40 generates a considerable amount of heat. Moreover, the carbon vanes tend to wear, which generates carbon dust that can interfere with operation of the compressor. Such vane wear also tends to create air gaps between the tips of the vanes 40 and the inner wall 15 of chamber 14. This can cause air leakage, which is detrimental to the efficiency of the compressor.

Figure 2:
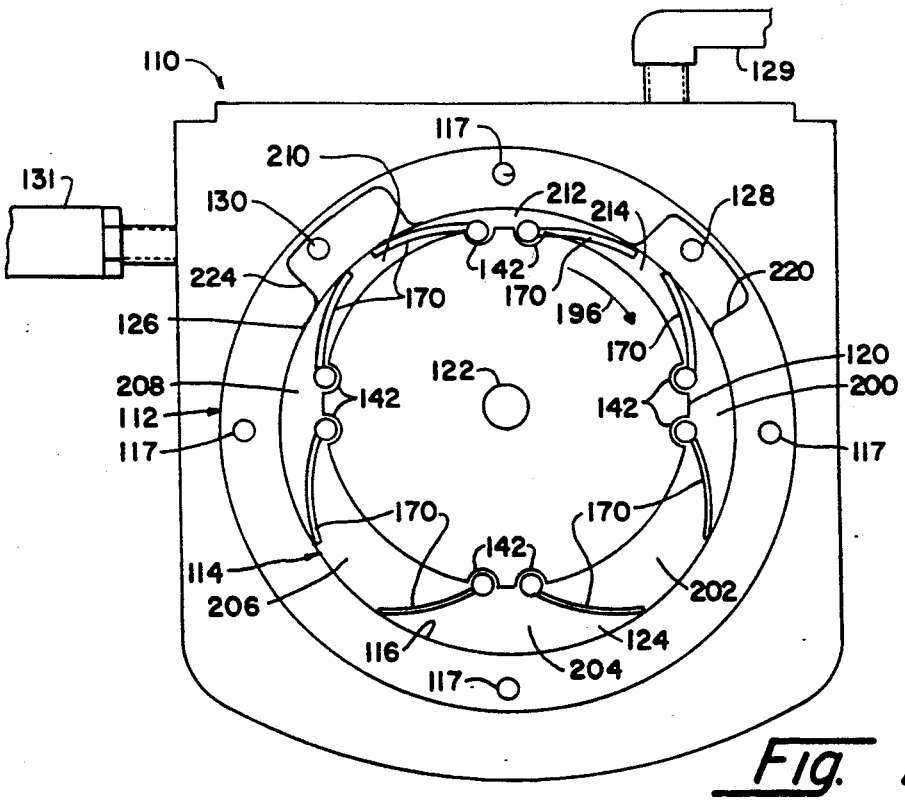
FIG. 2 is an elevational view of the pivoting vane rotary compressor of this invention, with an end plate removed to illustrate the rotor, chamber, intake and exhaust ports and pivoting vanes.

The above difficulties are overcome by the present invention, which is illustrated in FIGS. 2–4. Compressor 110 includes a housing 112 that features a generally cylindrical inner chamber 114. The chamber is defined by a cylindrical inner wall 116 composed of Teflon (TM) or a similar low friction material. As best shown in FIG. 3, the ends of housing 112 are sealed by plates 118 and 119 that are attached to the housing by bolts engaged through openings (not shown) in the plates and corresponding threaded openings 117, FIG. 2. The gap between these plates and housing 112 is exaggerated somewhat for clarity. In practice, the gap is approximately 1/1000". Plates 118 and 119 are likewise composed of Teflon or a similar material.

A cylindrical rotor 120 is mounted eccentrically within chamber 114. More particularly, rotor 120 is fixedly mounted on a shaft 122 that extends through chamber 114 and is itself rotatably mounted through plates 118 and 119. Because it is mounted eccentrically within chamber 114, rotor 120 is surrounded by a main chamber region 124, which gradually narrows to a constricted chamber region 126. An intake port 128 and an exhaust port 130 communicate with chamber 114. More particularly, constricted chamber region 126 is proximate to and communicates with exhaust port 130. The main chamber region 124 extends between constricted chamber region 126 and intake port 128. Intake valve 128 is communicably interconnected with a conventional air inlet line 129 and exhaust port 130 is similarly communicably interconnected with a conventional air exhaust line 131.

Rotor 120 includes eight or some other plurality of longitudinal channels 142 formed on its circumferential surface. As represented in FIG. 5, each channel has a generally circular cross sectional shape and an entrance 160 that is formed in the circumferential surface of the rotor. The channel extends arcuately somewhat greater than 180°. As a result, the interior of each channel includes a diameter that is larger than entrance 160. The channels 142 are typically spaced evenly apart about rotor 120, although in alternative embodiments uneven spacing arrangements may be utilized.

A plurality of vane elements 170, composed of a wear and heat resistant material such as Teflon (TM), are inserted respectively in the rotor channels 142. A single representative vane 170 is illustrated in FIGS. 5 and 6. As shown therein, each vane element includes a generally cylindrical pin portion 186 and an elongate arcuate portion 188 that extends integrally from pin portion 186. Each vane element 170 is mounted to rotor 120 by inserting its pin element 186 into a respective one of the channels 142. In particular, the pin 186 is inserted into the channel 142 by removing one of the plates 118 and 119 at the ends of housing 112 and sliding the pin 186 into its respective channel in the direction of arrow 192, FIG. 4. As best shown in FIGS. 3 and 4, when inserted in this manner each vane extends generally longitudinally along rotor 120 and has a length generally equal to that of the rotor. As shown in FIG. 5, the pin portion 186 has a diameter that is somewhat larger than the entrance 160 of the rotor channel. As a result, the vane element is secured radially to the rotor. At the same time, pin portion 186 is pivotable within that channel. As a result, each vane is permitted to pivot or rock relative to rotor 120, as indicated by double headed arrow 190. As best shown in FIGS. 2 and 4, the arcuate portions 188 of each adjacent pair of vanes 170 extend into chamber 114 in generally opposite directions about rotor 120.

In operation, shaft 122 and rotor 120 are rotatably driven in the direction of arrows 196, FIG. 2, by motor 194, FIG. 3. As a result, pivoting vanes 170 rock or pivot outwardly such that their outer tips engage the inner wall 116 of chamber 114. The vanes thereby define a plurality of compartments 200, 202, 204, 206, 208, 210 and 212 within chamber 114 and, more particularly, between rotor 120 and inner chamber wall 116. Air is introduced through line 129 and intake port 128 into the chamber via these compartments as they successively pass adjacent to the intake port. For example, in FIG. 2 compartment 200 is passing by the intake port. As a result, the air is introduced through port 128 into compartment 200 and this air is transmitted by the rotating vanes through main chamber portion 124 toward constricted chamber region 126. This causes the air in compartment 200 to be compressed by the narrowing chamber. Eventually, the compressed air is delivered to and discharged through exhaust port 130. From there the compressed air is delivered through line 131 to the filter beds of the oxygen concentrator or other apparatus. As each of the other compartments passes by port 128, that compartment likewise transmits air to the constricted region 126 so that such air is compressed and discharged. As the air encounters constricted region 126, the pressure in certain of the compartments, for example compartment 208, may be sufficient to offset the centrifugal force acting on the vanes and open slightly the arcuate portion 188 of trailing vane 170. As a result, air may escape from compartment 208 into trailing compartment 206. Due to the configuration of its trailing vane, compartment 206 remains substantially closed and delivers the escaped air to exhaust port 130. This structure enables rotor 120 to slip and avoid malfunction due to pressure build-ups and blockages.

Friction, heat and vane wear is reduced significantly during the operation of compressor 10 because both the vanes 170 and the inner chamber wall 116 are composed of a friction and wear-resistant material such as Teflon (TM). Reciprocating sliding vane movement is eliminated completely. As a result, carbon dusting and air leakage are minimized. Additionally, the corners 220 and 224 of intake and exhaust ports 128 and 130, respectively, are chamfered so that the pivoting vanes are not caught or snagged against the edges of the intake and exhaust ports. As a result, the entire apparatus rotates smoothly within chamber 114 and a highly efficient and maintenance free rotary compressor operation is achieved.

Although specific features of the invention are shown in some drawings and not others, this is for convenience only, as each feature may be combined with any or all of the other features in accordance with the invention.

Other embodiments will occur to those skilled in the art and are within the following claims:

What is claimed is:

1. A rotary compressor comprising:

a housing having a generally cylindrical chamber;

a generally cylindrical rotor mounted eccentrically in said chamber to define about said rotor a main chamber region, which narrows to a constricted chamber region; said rotor including a circumferential surface having a generally uniform radius and a plurality of axially parallel and circumferentially spaced apart channels formed therein;

an intake port formed in said housing for introducing air into said main chamber region;

an exhaust port formed in said housing for discharging air from said constricted chamber region;

at least one pair of vane elements, each vane element being pivotably engaged with a respective one of said channels and extending therefrom into said chamber to cover at least a portion of said circumferential surface of said rotor; said vane elements of each said pair including respective arcuate portions that extend in generally opposite directions from respective channels, about said rotor; said constricted region having a sufficient width to permit said vane elements to pivot away from said rotor; and means for rotatably driving said rotor in a single direction such that each said vane element releasably engages the wall of said chamber and said vane elements define compartments that transmit air from said main chamber region to said constricted chamber region, whereby said air is compressed and discharged through said exhaust port, each vane element including a distal portion that is spaced apart from said circumferential surface of said rotor during the entire rotation of said rotor.

2. The compressor of claim 1 in which said rotor includes a plurality of peripheral channels and each vane element includes a pin portion that is rotatably received by a respective channel to permit said vane element to pivot relative to said rotor.

3. The compressor of claim 2 in which each said vane element further includes an arcuate portion that extends from said pin portion.

4. The compressor of claim 1 in which each vane element comprises a heat resistent material.

5. The compressor of claim 4 in which said heat resistent material comprises Teflon (TM).

6. The compressor of claim 1 in which the wall of said chamber comprises Teflon (TM).

7. The compressor of claim 1 in which at least one of said intake port and exhaust ports includes a chamfered entrance.

* * * * *